United States Patent [19]

Kamiya et al.

[11] Patent Number: 4,482,479

[45] Date of Patent: Nov. 13, 1984

[54] PROCESS FOR TREATING WASTE GAS IN REPROCESSING OF USED NUCLEAR FUEL

[75] Inventors: Kunio Kamiya; Hideo Yusa; Fumito Nakajima, all of Hitachi; Masato Takeuchi, Katsuta, all of Japan

[73] Assignee: Hitachi, Ltd., Tokyo, Japan

[21] Appl. No.: 428,386

[22] Filed: Dec. 26, 1973

[30] Foreign Application Priority Data

Dec. 27, 1972 [JP] Japan ..... 47-129897

[51] Int. Cl.[3] ..... G21F 9/02

[52] U.S. Cl. ..... 252/630; 252/631; 423/249

[58] Field of Search ..... 423/249; 252/301.1 WD, 252/630, 631

[56] References Cited

U.S. PATENT DOCUMENTS

| | | | |
|---|---|---|---|
| 3,501,923 | 3/1970 | Lehmer | 252/301.1 W |
| 3,748,864 | 7/1973 | Lofredo et al. | 252/301.1 W |
| 3,944,646 | 3/1976 | Martin | 423/219 |

OTHER PUBLICATIONS

Bendixsen et al., "Operation of the ICPP Rare-Gas Recovery Facility During Fiscal Year 1970", IC-P-1001, pp. ii-v and 1-12, U.S.A.E.C., 1971.

Bendixsen et al., "Rare-Gas Recovery Facility at the Idaho Chemical Processing Plant", IN-1221, pp. ii-v and 1-15, U.S.A.E.C., 1969.

Bendixsen et al., "Rare-Gas Recovery Facility at the ICPP", Transaction of the American Nuclear Society, 1969 Winter Meeting, pp. 497-498, 1969.

Bendixsen et al., "Operational Performance and Safety of a Cryogenic System for Krypton Recovery", Transactions of the American Nuclear Society 1972 Annual Meeting, pp. 97-98, 1972.

*Primary Examiner*—Stephen J. Lechert, Jr.

*Attorney, Agent, or Firm*—Antonelli, Terry & Wands

[57] ABSTRACT

A waste gas generated in the reprocessing of used nuclear fuel is at first subjected to removal of explosive, gaseous substances such as hydrocarbons and nitrogen oxides, and materials capable of forming the explosive gaseous substances, such as oxygen, and condensible substances such as carbon dioxide, water and ammonia from the waste gas, and then to cryogenic distillation, thereby separating and recovering Kr-85 from the waste gas. As the separation and recovery of Kr-85 is carried out by cryogenic separation after the removal of the substances having a possibility to explode in a cryogenic distillation apparatus and also the removal of condensible substances having a possibility to clog a piping system of the apparatus, the operation of the apparatus is ensured. It is also disclosed that the oxygen and nitrogen oxides can be completely removed by catalytic hydrogen reduction.

13 Claims, 5 Drawing Figures

PROCESS FOR TREATING WASTE GAS IN REPROCESSING OF USED NUCLEAR FUEL

BACKGROUND OF THE INVENTION

This invention relates to a process for separating and recovering Kr-85 from a waste gas generated in the reprocessing of used nuclear fuel by cryogenic distillation, and more particularly to a process for separating and recovering Kr-85 by removing explosive gaseous substances, or materials capable of forming explosive gaseous substances or condensible substances, which may clog a piping system of a cryogenic distillation apparatus from the waste gas, and then leading the gas to the cryogenic distillation apparatus: In other words, the present invention concerns a process for treating a waste gas from the reprocessing of nuclear fuel with an increased safety of operation of the cryogenic distillation apparatus used for the separation and recovery of Kr-85.

It is very important from the viewpoint of effective utilization and reduction in operating cost of nuclear facility to recover and reuse the effective components contained therein after burning the nuclear fuel to some extent. In the reprocessing of the used nuclear fuel destined to the reuse of the nuclear fuel, clad tubes of fuel elements are dismantled, and the nuclear fuel is taken out of the fuel elements and dissolved in a nitric acid solution, while blowing oxygen or air into the solution. Then, oxygen or air is further blown into the resulting nitrate solution of the nuclear fuel to precipitate the impurities, and then the solution is transferred to a step for recovering the effective components.

As the dissolution and precipitation treatments, radioactive, gaseous substances including Kr-85 (the substances will be hereinafter referred to as Kr-85) are evolved from the nuclear fuel. Furthermore, a considerable amount, for example, several hundred ppm, of nitrogen oxides, NOx, is generated owing to the use of the nitric acid solution. Furthermore, hydrocarbons are contained therein.

Since the waste gas containing Kr-85 cannot be discharged to the atmosphere as such, it is necessary to separate and recover Kr-85 from the waste gas, keep it stored for a half-value period of Kr-85 to make Kr-85 harmless, and then dispose it. A very large amount of the waste gas is evolved from the reprocessing plant of the nuclear fuel, but as a result of studies, the present inventors have already confirmed that a cryogenic distillation process is most suitable for treating such a large amount of the gas. On the basis of the finding, two of the present inventors developed several processes for separating and recovering Kr-85 from the waste gas by the cryogenic distillation process, one of which is disclosed in H. Yusa et al U.S. patent application Ser. No. 335,749, with a title "Process and apparatus for separating and recovering krypton-85 from exhaust gas of nuclear reactor or the like", filed on Feb. 26, 1973.

In the treatment of the waste gas in the cryogenic distillation apparatus, it is necessary to remove condensible substances such as carbon dioxide, water, etc. in advance, because there is a danger of clogging the piping system of the cryogenic distillation apparatus with these condensible substances. These condensible substances can be removed from the waste gas by dehumidification, adsorption by active carbon, condensation-separation, or absorption by acid or alkali. As a result of further study on the process for separating and recovering Kr-85 by the cryogenic distillation method, the present inventors have confirmed that the hydrocarbons, nitrogen oxides, and oxygen contained in the waste gas are hazardous substances to the process for separating and recovering Kr-85. That is to say, hydrocarbons and nitrogen oxides have a possibility of explosion within the cryogenic distillation apparatus, and further oxygen can produce explosive substances, that is, ozone and nitrogen oxides, through action of radioactive rays. Furthermore, in view of the current situations that control on the industrial wastes are severer year by year, it is not preferable to discharge a waste gas containing a large amount of nitrogen oxides, which are regarded as origins of photochemical smogs, to the atmosphere as such. Therefore, it is desirable to make the nitrogen oxides harmless within the waste gas-treating plant.

SUMMARY OF THE INVENTION

An object of the present invention is to to provide a process for separating and recovering Kr-85, including not only the removal of condensible substances inconvenient for the operation of cryogenic distillation apparatus, but also the removal of hazardous explosive gaseous materials and gaseous materials capable of producing explosive substances in advance.

Another object of the present invention is to provide a process for separating and recovering Kr-85 in a cryogenic distillation apparatus after removal of oxygen, nitrogen oxides, hydrocarbon and condensible substances from a waste gas generated in the reprocessing of nuclear fuel containing a step of precipitating impurities from a solution resulting from the dissolution of the used nuclear fuel in nitric acid by blowing oxygen or air.

Other object of the present invention is to provide a process for separating and recovering Kr-85 safely by cryogenic distillation, including steps of catalytically oxidizing hydrocarbons contained in the waste gas generated in the reprocessing of the used nuclear fuel to convert them to non-explosive substances, and also catalytically reducing oxygen and nitrogen oxides to convert them to non-explosive substances.

Further object of the present invention is to provide a process for separating and recovering Kr-85 by cryogenic distillation while conducting hydrogen reduction of oxygen and nitrogen oxides safely.

Still further object of the present invention is to provide a process for separating and recovering Kr-85, including a step of further treating the oxygen and hydrogen remaining after the conversion of oxygen and nitrogen oxides to the non-explosive substances to completely remove these hazardous components from the waste gas.

Treatment of the waste gas generated in the reprocessing of the used nuclear fuel, including the removal of the explosive, gaseous substances, materials capable of producing the explosive, gaseous substances, and condensible substances from the waste gas, and separation and recovery of Kr-85 from the resulting clean waste gas by cryogenic distillation, can be completely and successfully accomplished in the present invention.

DETAILED EXPLANATION OF THE EMBODIMENTS

This invention includes a step of removing materials capable of forming explosive, gaseous substances, and the explosive gaseous substances themselves, such as oxygen, nitrogen oxides, hydrocarbons, etc., contained in the waste gas before leading the waste gas containing Kr-85 to the cryogenic distillation apparatus. It is prossible to remove the nitrogen oxides and hydrocarbons by adsorption or condensation, but it seems effective in view of the efficiency and reliability of removal to convert these substances to non-explosive substances catalytically. Therefore, in the following example, a catalytic removal will be described. Furthermore, the present invention includes a step of removing the condensible substances from the waste gas in advance. The condensible substances are carbon dioxide, water, etc. contained in the air, and also carbon dioxide, water, ammonia, etc. resulting from the catalytic conversion of oxygen and nitrogen oxides, and can be removed according to the well known methods, for example, by adsorption, dehumidification, condensation, water washing or absorption by a chemical solution such as acid or alkali solution. However, in view of the easiness in the treatment as well as efficiency, explanation will be made as to water by way of condensation and dehumidification, and as to carbon dioxide and ammonia by way of absorption by a chemical solution.

Figure 1:
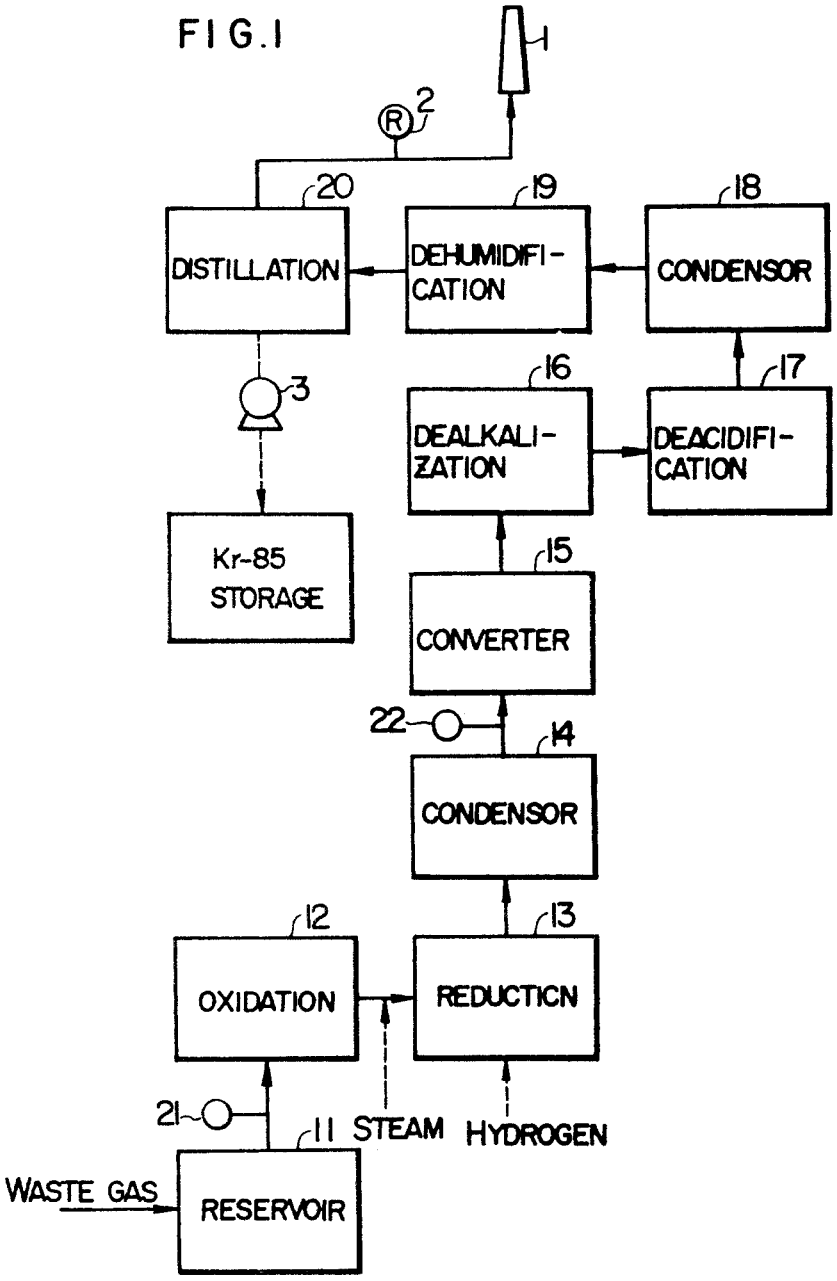
FIG. 1 is a flow diagram showing one embodiment of a process for separating and recovering Kr-85 from a waste gas evolving from the reprocessing of the used nuclear fuel according to the present invention.

In FIG. 1, a waste gas continuously or intermittently discharged from a nuclear fuel reprocessing plant is stored in a reservoir 11 tentatively. The waste gas contains nitrogen as a main component, but still contains about 30% by volume of oxygen. A waste gas containing about 100 pm Kr-85 is discharged at a rate of about 1,000 $Nm^3$/day from a reprocessing plant destined to low-concentrated uranium fuel with a treating capacity of 1 ton/day. Further, the waste gas contains several hundred ppm nitrogen oxides ($NO_2$, NO, $N_2O$, etc.), less than about 100 ppm hydrocarbons, several hundred ppm carbon dioxide, several hundred ppm water, etc.

It is not always necessary to remove the hydrocarbons at first, because the hydrocarbons do not take part in the hydrogen reduction reaction of oxygen and nitrogen oxides. However, in FIG. 1, hydrocarbons are oxidized in an oxidation zone 12 containing a proper catalyst at first by passing the waste gas through the oxidation zone 12. Well-known catalysts of noble metal system, copper system, noble metal-manganese system, noble metal-chromium system, copper-chromium system, copper-manganese system, etc. are used for the oxidation of the hydrocarbons. That is, the hydrocarbons are oxidized by passing the waste gas through a column packed with these catalysts, thereby producing carbon dioxide and water. The carbon dioxide and water can be removed by water washing, absorption by an alkali solution or condensation. When a gas containing 200 ppm hydrocarbons was passed through a catalyst column packed with chromium and manganese catalysts and kept at a temperature of 100° to 800° C. at a space velocity of 1000 $hr^{-1}$, it was found that the hydrocarbon concentration of the gas at the outlet of the catalyst column was not more than 0.1 ppm at the catalyst column temperature of 300° C. or higher. Thus, 99.9% or more of hydrocarbons can be oxidized at 300° to 800° C.

The waste gas freed from the hydrocarbons is then sent to a reduction zone 13 containing a hydrogen reduction catalyst. An almost stoichimetrically equivalent amount of hydrogen gas to that of oxygen and nitrogen oxides is added to the waste gas in the reduction zone to reduce the oxygen and nitrogen oxides. Since the waste gas contains about 30% by volume of oxygen, the direct addition of the hydrogen gas to the waste gas may lead to explosion. Therefore, the hydrogen gas must be added thereto after it is diluted with other gas, for example, steam to less then the explosion limit (less than 4% by volume in the normal state). The composition and flow rate of the waste gas to be treated often changes, and therefore it is desirable to provide a pressure control valve at the upstream side of the reservoir 11 to make the flow rate constant, and further control a rate of the hydrogen gas to be added to the waste gas by means of the well known oxygen concentration meter 21. The method for removing the oxygen by catalytic reduction with hydrogen was invented by one of the present inventors (Nakajima: U.S. Pat. No. 3,535,074 with a title: "Method and apparatus for purifying crude inert gases"). The catalysts, and the art of controlling the rate of hydrogen gas to be added, disclosed in said U.S. patent, can be also utilized in the present invention.

Figure 2:
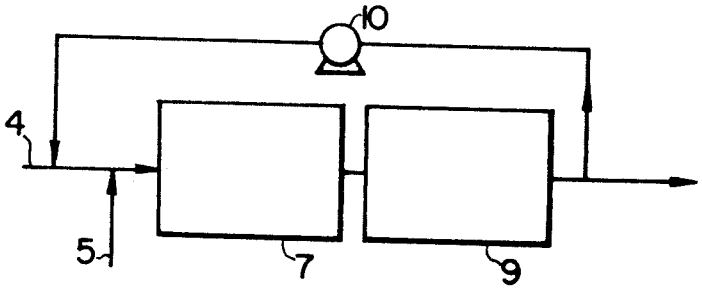
FIG. 2 is a flow diagram showing one embodiment of a method for adjusting a concentration of hydrogen added to the waste gas for the reduction of oxygen and nitrogen oxides.

As the diluent to the hydrogen gas, steam prepared in a boiler can be used, as described above, but a waste gas resulting from the hydrogen reduction can be also utilized. The higher the flow rate of the waste gas, the more the amount of steam used. Consequently, a capacity of a boiler and also a capacity of the hydrogen reduction apparatus are increased, and the recyclic use of the waste gas resulting from the hydrogen reduction can reduce the capacity of the apparatus. This embodiment is illustrated in FIG. 2. In FIG. 2, the waste gas passing through the reduction catalyst column 7 and condenser 9 is returned to the duct 4 at the upstream side of the catalyst column 7 by means of a blower 10. It is of course possible to add steam 5 to the waste gas at the same time. Hydrogen is prepared by decomposition of ammonia or electrolysis of water.

Figure 4:
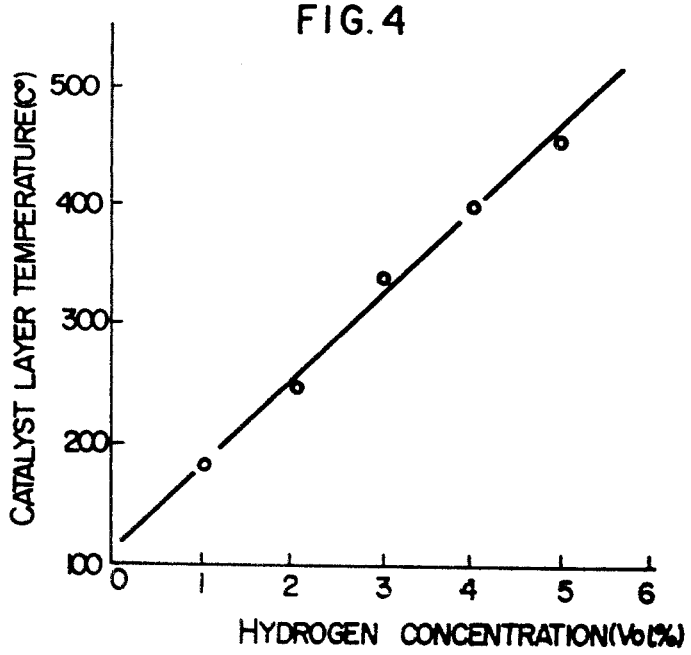
FIG. 4 is a graph showing a relation between the temperature of catalyst layer and hydrogen concentration in a catalytic hydrogen reduction column.

The hydrogen concentration of the waste gas is controlled to less than 4% by volume, in the manner as described above. Now, it will be studied whether the reduction of oxygen and nitrogen oxides can be sufficiently carried out at such a low hydrogen concentration. As is well known, the catalyst temperature will be elevated with increasing hydrogen concentration. It is seen from FIG. 4 that the catalyst temperature is increased by about 70° C. at every 1% increase (by volume) in the hydrogen concentration. When the catalyst temperature is too high, the catalyst will be deteriorated by sintering of the active centers of the catalyst. Therefore, it is preferable not to elevate the catalyst temperature too high. FIG. 4 shows data obtained by making an alumina carrier to hold palladium, packing the resulting catalyst in a column to obtain a catalyst layer, 5 cm thick and 30 cm in diameter, and passing a gas consisting of hydrogen and oxygen at a ratio by volume of hydrogen:oxygen being 2:1 at a flow rate of 46 $m^3$/hr in an axial direction of the column.

Figure 5:
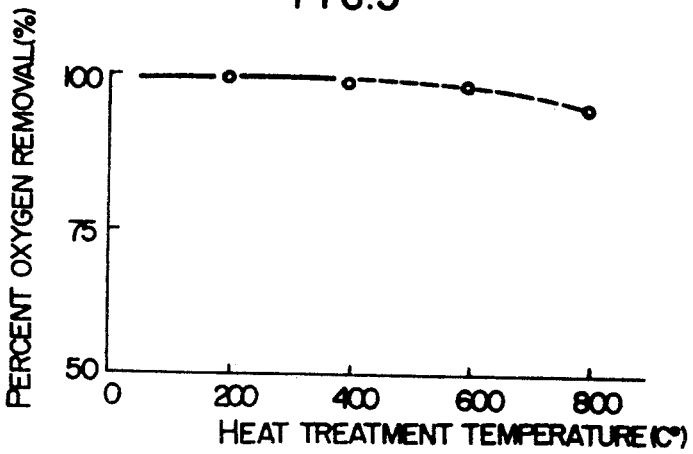
FIG. 5 is a graph showing a heat deterioration characteristic of the catalyst used in the hydrogen reduction.

It is seen from FIG. 4 showing the relation between the catalytic activity and temperature that the catalytic activity starts to decrease when the heat treatment temperature of the catalyst exceeds 400° C. Since it is seen from FIG. 4 that the hydrogen concentration corresponding to the catalyst temperature of 400° C. is about 4% by volume, the reduction reaction can be carried out without any danger of explosion or reduction in catalytic activity, if the hydrogen concentration of the waste gas can be kept below 4% by volume. FIG. 5 shows data obtained by heating the catalyst for one hour at a temperature given on the abscissa, and then treating a gas containing 4% by volume of hydrogen and 2% by volume of oxygen at a catalyst temperature of 200° C.

Well known catalysts of platinum system, palladium system, etc. are used as the catalyst for hydrogen reduction. Through the reduction reaction, oxygen is converted to water, and nitrogen oxides to ammonia, nitrogen and water. The resulting ammonia can be removed by acid washing and water by cooling and condensation. The acid entrained into the waste gas at the acid washing of ammonia can be removed by alkali washing.

When oxygen concentrations in an axial direction of a palladium catalyst layer, 30 cm in diameter and 50 cm long, were measured by passing a steam containing 1.8% by volume of hydrogen and 0.9% by volume of oxygen through the catalyst layer at 110° C. and 1 atm at a flow rate of 120 $m^3$/hr, the concentration was less than 1 ppm at a location 5 cm far from the inlet of the catalyst layer, and the final oxygen concentration was $4\times10^{-84}$ ppm by extrapolating the outlet oxygen concentration. That is, oxygen could be completely removed, Likewise, it was found that the nitrogen oxides could be removed from the waste gas. That is, when a gas containing 100 ppm nitrogen oxides was treated with the same palladium catalyst layer as above, 80% of the nitrogen oxides could be converted to ammonia, and the balance to nitrogen and water. The resulting ammonia could be removed by absorption in a hydrochloric acid or sulfuric acid solution, and the acid entrained into the waste gas could be removed by the ordinary alkali washing of sodium hydroxide, etc.

Then, the water resulting from the hydrogen reduction is removed by a condensor 14. That is, the waste gas passed through the hydrogen reduction is cooled to room temperature to roughly remove water, and then dehumidified by molecular sieve or cooled down to a dew-point of the waste gas.

it is important to control an amount of hydrogen to be added, so that the hydrogen may be always in a stoichiometrically equivalent amount to that of oxygen and nitrogen oxides, but it is not easy to carry out exact control of hydrogen amount, because the composition of waste gas from the reservoir 11 is liable to fluctuate. When the hydrogen is in excess, it remains in the waste gas, and if the hydrogen is short, oxygen and nitrogen oxides remain in the waste gas. To remove the remaining hydrogen or oxygen and nitrogen oxide, it is preferable to pass the waste gas through a converter 15 containing a catalyst layer. As the catalyst, metal or metal oxide having at least two different valencies is suitable. That is to say, oxygen and nitrogen oxides, if they remain in the waste gas, oxidize said catalyst or oxidize it to oxides of higher valency to catch themselves. On the other hand, hydrogen, if it remains in the waste gas, can reduce the catalyst or the catalyst to oxides of lower valency to form water and thereby eliminate hydrogen. When any one of these components remains continuously, its concentration is measured by an oxygen concentration meter 21 and hydrogen concentration meter 22 to control a feed rate of hydrogen. The art of controlling the hydrogen feed rate for the removal of the remaining hydrogen and oxygen, as described in said U.S. Pat. No. 3,535,074, can be utilized. The catalysts utilized for the removal of the remaining hydrogen and oxygen are copper, copper oxide, uranium dioxide, triuranium octoxide, etc. Copper is converted to copper monoxide through contact with oxygen and nitrogen oxides, and uranium dioxide to triuranium octoxide. The conversion is quite reversed in the case of contact with hydrogen. According to the experiment conducted by the present inventors, 99.9% or more of oxygen, hydrogen and nitrogen oxides can be removed by this treatment.

Figure 3:
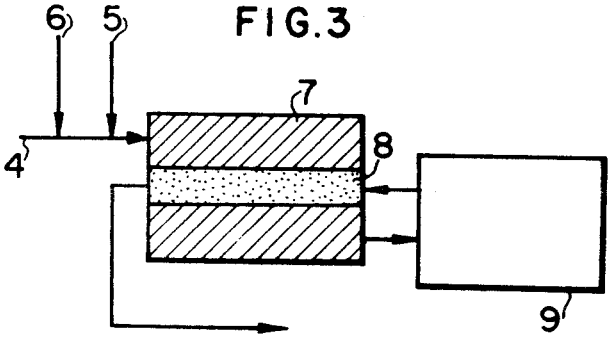
FIG. 3 is a flow diagram showing one embodiment of a system for hydrogen reduction of oxygen and nitrogen oxides used in the present invention.

FIG. 3 shows an embodiment of an arrangement of oxidation-reduction catalysts for removing the remaining oxygen, nitrogen oxides and hydrogen. A waste gas duct 4 is connected to an inlet of a hydrogen reduction catalyst layer 7 arranged around an oxidation-reduction catalyst layer 8. Hydrogen is introduced into the duct 4 from a duct 6, and a diluent gas such as steam, etc. is introduced therein from a duct 5. First of all, the waste gas is subjected to reaction of oxygen and nitrogen oxides with hydrogen in the hydrogen reduction catalyst layer 7, and then to water removal in a condenser 9. Then, the waste gas is led to the oxidation-reduction catalyst layer 8, wherein the remaining gas components oxidize or reduce the catalyst, and then discharged therefrom. By such arrangement, the heat generated in the hydrogen reduction catalyst layer 7 can be utilized for heating the oxidation-reduction catalyst layer 8, whereby the conversion can be elevated.

In the manner as described above, the explosive, gaseous substances such as oxygen, nitrogen oxides, and hydrocarbons, can be converted to non-explosive substances, and such condensible substances such as water, ammonia, carbon dioxide, etc. resulting from the conversion are removed by condensation, acid washing and alkali washing. In FIG. 1, one unit each for dealkalization 16, deacidification 17 and condensation 18 is illustrated, but of course it is not necessary to arrange these units in such a sequence, and these treatments can be carried out at the downstream side of the respective reaction section. Through the treatments of the waste gas to remove the impurities, a clear waste gas is obtained. However, to ensure a safety of operation of a cryogenic distillation apparatus 20, the clean waste gas is passed through a dehumidification unit 19, where a dehumidifying agent such as molecular sieve, etc. is used. Then, the clean waste gas is led to the cryogenic distillation apparatus to separate and recover Kr-85. The cryogenic distillation apparatus itself is well known, but the apparatus as described in said U.S. patent application Ser. No. 335,749 may be utilized.

The concentrated Kr-85 (for example 80% by volume or higher) is withdrawn from the cryogenic distillation apparatus and kept stored in storage vessels such as cylinders by means of a complssor 3. When a waste gas containing 100 ppm Kr-85 was treated at a rate of 1000 $Nm^3$/day according to the process as described above, a concentrated Kr-85 gas containing 80% by volume of Kr-85 was obtained without any trouble in the cryogenic distillation apparatus. Thus, the annual volume of recovered gas amounted to 46 $Nm^3$ or less.

The waste gas balance freed from Kr-85 was vented to the atmosphere through a vent stack 1 after confirming the safety of the gas by means of a radioactivity detector 2.

What is claimed is:

1. A process for separating and recovering Kr-85 by cryogenic distillation from a waste gas containing Kr-85 evolved from reprocessing of used nuclear fuel, which comprises catalytically converting hydrocarbons in the waste gas containing Kr-85 into non-explosive, condensible substances in the presence of oxygen and catalytically converting explosive, gaseous substances and materials capable of forming the explosive, gaseous substances in the waste gas containing Kr-85 into non-explosive, condensible substances in the presence of hydrogen gas, thereby obtaining a waste gas free of hydrocarbons and explosive substances and materials capable of forming the explosive substances, removing the condensible substances from the waste gas containing Kr-85, thereby obtaining a clean waste gas freed from said hydrocarbons and explosive substances and materials capable of forming the explosive substances and condensible substances prior to introducing the clean waste gas into a cryogenic distillation apparatus, and liquefying and distilling the clean waste gas into the cryogenic distillation apparatus, thereby separating and recovering Kr-85 from the clean waste gas.

2. A process for separating and recovering Kr-85 from a waste gas containing Kr-85 evolved from reprocessing of used nuclear fuel, said reprocessing involving steps of dissolving the used nuclear fuel in nitric acid to prepare a solution of nitrate compounds of the nuclear fuel, and contacting the solution with oxygen to precipitate impurities whereby the waste gas also contains nitrogen oxide, oxygen and hydrocarbons, which comprises catalytically converting hydrocarbons, nitrogen oxides and oxygen contained in the waste gas containing Kr-85 to non-explosive substances by reacting the hydrocarbons with the oxygen and by reacting nitrogen oxides and oxygen with hydrogen added to the waste gas, thereby obtaining a waste gas free of hydrocarbons, nitrogen oxide and oxygen, removing condensible substances resulting from the conversion and condensible substances contained in the waste gas, thereby preparing a clean waste gas free from the hydrocarbons, nitrogen oxides, oxygen and condensible substances prior to introducing the waste gas into a cryogenic distillation apparatus, and liquefying and distilling the clean waste gas in the cryogenic distillation apparatus, thereby separating and recovering Kr-85 from the clean waste gas.

3. A process for separating and recovering Kr-85 from a waste gas containing Kr-85 evolved from reprocessing of used nuclear fuel, said reprocessing involving steps of dissolving the used nuclear fuel in nitric acid to prepare a solution of nitrate compounds of the nuclear fuel, and contacting the solution with oxygen to precipitate impurities whereby the waste gas also contains nitrogen oxides, oxygen and hydrocarbons, which comprises converting hydrocarbons contained in the waste gas to carbon dioxide and water, adding an almost stoichiometrically equivalent amount of hydrogen to that of oxygen and nitrogen oxides contained in the waste gas to the waste gas, converting the oxygen to water and the nitrogen oxides to nitrogen, water and ammonia in the presence of a catalyst, thereby obtaining a waste gas free of hydrocarbons, oxygen and nitrogen oxides, removing from the waste gas the carbon dioxide, water and ammonia resulting from said conversion and water and carbon dioxide contained in the waste gas, thereby obtaining a clean waste gas free from said hydrocarbons, oxygen, nitrogen oxides, carbon dioxide, water and ammonia prior to introducing the waste gas into a cryogenic distillation apparatus, and liquefying and distilling the clean waste gas in the cryogenic distillation apparatus, thereby separating and recovering Kr-85 from the clean waste gas.

4. A process for separating and recovering Kr-85 by cryogenic distillation from a waste gas containing K-85 evolved from reprocessing of nuclear fuel, said reprocessing involving steps of dissolving used nuclear fuel in nitric acid, thereby preparing a solution of nitrate compounds of the nuclear fuel, and blowing oxygen into the solution, thereby precipitating impurities whereby the waste gas containing Kr-85 also contains explosive substances and oxygen, which comprises converting explosive substances and oxygen contained in the waste gas to non-explosive substances, and condensible substances containing ammonia, by catalytic reaction, thereby obtaining a waste gas free of explosive substances and oxygen, separating the condensible substances containing ammonia from the waste gas by condensation and by contacting the waste gas with an acidic solution prior to introducing the waste gas containing Kr-85 to a cryogenic distillation apparatus, thereby obtaining a clean waste gas free of said explosive substances, oxygen and condensible substances containing ammonia, and liquefying and distilling the waste gas in the cryogenic distillation apparatus, thereby separating and recovering Kr-85.

5. A process for separating and recovering Kr-85 from a waste gas containing Kr-85 evolved from reprocessing of used nuclear fuel, said reprocessing involving steps of dissolving used nuclear fuel in nitric acid, thereby preparing a solution of nitrate compounds of the nuclear fuel, and blowing oxygen into the solution, thereby precipitating impurities whereby said waste gas containing Kr-85 also contains hydrocarbons, nitrogen oxides, and oxygen, which comprises catalytically oxidizing hydrocarbons contained in the waste gas in an oxidation zone containing a catalyst to carbon dioxide and water, adding to the waste gas an almost stoichiometrically equivalent amount of hydrogen to that of oxygen and nitrogen oxides contained in the waste gas, catalytically reducing the oxygen and nitrogen oxides contained in the waste gas in the presence of a catalyst to water, and nitrogen, water and ammonia, respectively, thereby obtaining a waste gas free of hydrocarbons, nitrogen oxides and oxygen, removing the water and carbon dioxide contained in the waste gas, and the water, carbon dioxide and ammonia resulting from the catalytic reactions from the waste gas, thereby obtaining a clean waste gas free of hydrocarbons, nitrogen oxides, oxygen, carbon dioxide, water and ammonia prior to introducing the waste gas into a cryogenic distillation apparatus, and liquefying and distilling the clean waste gas in the cryogenic distillation apparatus, thereby separating and recovering Kr-85 from the clean waste gas.

6. A process according to claim 5, wherein the water is removed by condensation from the waste gas after the catalytic reactions.

7. A process according to claim 5, wherein the water is removed by condensation from the waste gas after the catalytic reactions, and the ammonia and carbon dioxide are removed through contact with an acid solution and alkali solution, respectively, by absorption, and then the waste gas is dehumidifed before the liquefaction and distillation.

8. A process according to claim 5, wherein the catalytic reduction of the oxygen and nitrogen oxides contained in the waste gas comprises a catalytic reduction reaction in a reduction zone and a catalytic conversion reaction wherein any oxygen and hydrogen remaining in the waste gas after the catalytic reduction reaction are catalytically converted to water by oxidation and reduction.

9. A process according to claim 8, wherein heat of reaction generated in the reduction of the oxygen and nitrogen oxides is transferred to the catalytic conversion reaction of the remaining hydrogen and oxygen by oxidation and reduction, thereby promoting the conversion reaction.

10. A process according to claim 5, wherein steam is added to the waste gas together with the hydrogen to be given to the reduction zone, thereby lowering a hydrogen concentration of the waste gas to less than an explosion limit.

11. A process according to claim 5, wherein the hydrogen to be given to the reduction zone is diluted with the waste gas after the reduction, thereby lowering a hydrogen concentration of the waste gas to less than an explosion limit.

12. A process for separating and recovering Kr-85 from a waste gas containing Kr-85 evolved from reprocessing of used nuclear fuel, said reprocessing involving steps of dissolving used nuclear fuel in nitric acid, thereby preparing a solution of nitrate compounds of the nuclear fuel, and blowing oxygen into the solution, thereby precipitating impurities whereby the waste gas containing Kr-85 also contains hydrocarbons, nitrogen oxides, and oxygen, which comprises catalytically oxidizing hydrocarbons contained in the waste gas in an oxidation zone containing a catalyst to carbon dioxide and water, adding to the waste gas an almost stoichiometrically equivalent amount of hydrogen to that of oxygen and nitrogen oxides contained in the waste gas, reducing the oxygen and nitrogen oxides contained in the waste gas in a reduction zone containing a catalyst to water, and nitrogen, water and ammonia, respectively, removing the resulting water from the waste gas by condensation, converting hydrogen and oxygen remaining in the waste gas to water by catalytic oxidation and reduction, thereby obtaining a waste gas free of hydrocarbons, nitrogen oxides and oxygen, removing the resulting water from the waste gas by condensation, contacting the waste gas with an alkali solution and acid solution, thereby removing the carbon dioxide and ammonia contained in the waste gas, respectively, removing the water entrained in the waste gas by condensation and further by dehumidification, thereby obtaining a clean waste gas free of hydrocarbons, nitrogen oxides, oxygen, carbon dioxide, water and ammonia prior to introducing the waste gas into a cryogenic distillation apparatus, and liquefying and distilling the clean waste gas in the cryogenic distillation apparatus, thereby separating and recovering Kr-85 from the clean waste gas.

13. A process according to claim 2, wherein the hydrogen is added in a stoichiometrically equivalent amount to that of the oxygen and nitrogen oxide contained in the waste gas.

* * * * *